United States Patent [19]

Zanella et al.

[11] 4,105,727

[45] Aug. 8, 1978

[54] PROCESS FOR PREPARING FIBRILS FOR USE IN THE MANUFACTURE OF PAPER

[75] Inventors: Giuseppe Zanella; Luciano Mancini, both of Ferrara, Italy

[73] Assignee: Montedison S.p.A., Milan, Italy

[21] Appl. No.: 740,678

[22] Filed: Nov. 10, 1976

[30] Foreign Application Priority Data

Nov. 11, 1975 [IT] Italy ..... 29189 A/75

[51] Int. Cl.[2] ..... B02C 18/00; C08F 6/00

[52] U.S. Cl. ..... 264/12; 264/140; 264/211; 528/502; 528/503

[58] Field of Search ..... 264/143, 13, 140, 12, 264/211; 260/94.9; 528/502, 503; 162/157 R

[56] References Cited

U.S. PATENT DOCUMENTS

| | | | |
|---|---|---|---|
| 2,831,845 | 4/1958 | Biddle et al. | 260/94.9 |
| 3,032,384 | 5/1962 | Releg et al. | 264/205 |
| 3,719,648 | 3/1973 | Frioliuk et al. | 264/143 |
| 3,891,499 | 6/1975 | Kato et al. | 264/13 |
| 3,976,631 | 8/1976 | Molen et al. | 264/205 |

FOREIGN PATENT DOCUMENTS

| | | | |
|---|---|---|---|
| 787,033 | 1/1973 | Belgium | 264/13 |
| 2,339,044 | 2/1974 | Fed. Rep. of Germany | 264/205 |
| 1,355,913 | 6/1974 | United Kingdom | 264/205 |

*Primary Examiner*—Jay H. Woo

[57] ABSTRACT

There is disclosed a process for preparing fibrils or microfibers of polypropylene which can be used in whole, or in part, as replacement for cellulose fibers in the manufacture of paper by conventional methods and which do not require cutting to adapt them to such use.

3 Claims, No Drawings

PROCESS FOR PREPARING FIBRILS FOR USE IN THE MANUFACTURE OF PAPER

The process of the invention involves extruding a solution or dispersion of polypropylene in n-hexane through a nozzle under flash-spinning conditions and hitting the extruding solution or dispersion of the polypropylene with a high-speed fluid angularly directed against the extruding solution or dispersion.

As is known, the terms "fibrils" or "microfibers" include long-shaped fibrous structures consisting of very thin filaments having a thickness varying from 1 to 400μ; a length of from 1 to 50 mm; a surface area (specific surface) exceeding 1 $m^2/g$; and which are generally used in preparing non-woven fabrics and synthetic paper.

Also known are methods of obtaining the fibrils, microfibers or similar fibrous structures useful in manufacturing paper by the flash-spinning of polymeric compositions coupled with the use of a high-speed gas jet, as heretofore mentioned.

According to one method described in Italian Pat. No. 947,919, and in Italian Patent Application No. 29,594 A/74 assigned to Montedison, S.p.A., which Italian application corresponds to the United States application of Giovanni DiDrusco et al, Ser. No. 847,172, filed Oct. 31, 1977, fibrils of olefin polymers are obtained by extruding, through an orifice, a solution or dispersion of such polymers which is at a temperature higher than the boiling temperature of the solvent under normal conditions and at autogenous pressure or higher, into an environment of lower pressure where it is hit by a high-speed jet of a gaseous fluid having an angular direction with respect to the direction of the solution or dispersion.

A similar process is described in German patent application DOS No. 2,339,044. In that method, the extruded polymer solution is hit by the gaseous fluid jet at an angle of less than 30° and at a speed which is at least ten times higher than the solution extrusion speed.

Further, according to Belgian Pat. No. 787,033, fibrils of olefin polymers, including fibrils of polypropylene, are obtained by flash-spinning a dispersion of the molten polymer in a solvent, and hitting the extruded mixture with a gas or vapor jet having a high speed and at an impact angle preferably comprised between 90° and 135°.

Polyolefins are among the synthetic polymers generally most utilized for preparing fibrils to be used in manufacturing synthetic or semi-synthetic paper or paper-like articles. Of the polyolefins, polypropylene is preferred because of the higher tenacity of its fibers and, consequently, the superior mechanical characteristics of the paper made therefrom. In principle, in the specific application of fibrils to the manufacture of synthetic paper, the fibrils must possess, in addition to high tenacity and a surface area exceeding 1 $m^2/g$, a suitable morphology, in particular a length not exceeding 3 mm and, very importantly, a uniform length, that is, the length of the fibrils must be comprised in a range of values as narrow as possible.

In general, given a certain polymer/solvent system, higher extrusion temperatures result in fibrils of better morphology for use in the paper field.

On the other hand, preparing polyolefin fibrils, particularly polypropylene fibrils, in a profitable way from the economic viewpoint, by the methods described above, depends for the most part on the possibility of connecting the fibril-forming operation directly with the process for polymerizing the olefins in suspension and using the polymerization liquid medium as the liquid medium for the composition to be extruded and hit by the high-speed jet.

In the case of polypropylene, for which polymerization solvents such as hexane and heptane are used, the production of fibrils by the aforesaid economically desirable method would involve the use of quite high temperatures, about 215° C if the polymerization solvent is n-hexane, even considerably higher if the polymerization solvent is n-heptane.

THE PRESENT INVENTION

An object of this invention is to provide a new and improved method for obtaining polypropylene fibrils from solutions or dispersions of the polymer and which have a particularly uniform morphology even when at relatively low extrusion temperatures.

We have found, in relation to the preparation of polypropylene fibrils from solutions or dispersions of the polymer in n-hexane by the flash-spinning method carried out in combination with the action of a gaseous fluid, that it is possible to obtain more homogeneous fibrils having optimum dimensions, expecially in regard to length, and even at relatively low extrusion temperatures, when the n-hexane solution or dispersion is extruded in the presence of propylene monomer dissolved in n-hexane in amounts of from 2 to 25 moles per 100 moles of the hexane-propylene solution.

The propylene monomer can be introduced into the polypropylene solution or dispersion prior to the extrusion, or it can be the unreacted propylene present in the unrefined (crude or total) polymerization reaction product obtained by polymerizing propylene in n-hexane in contact with specific catalysts according to known techniques.

In this last-mentioned embodiment, it is possible to profitably use the unrefined polymerization reaction product after exhaustion of the catalyst and after bringing said reaction product to the extrusion conditions.

As indicated above, by carrying out the extrusion in the presence of the propylene monomer in the amounts stated, it is possible to obtain polypropylene fibrils of particularly uniform morphology even at relatively low temperatures, i.e., at about 180° C for a propylene content of 25 mols per 100 mols of hexane-propylene solution. However, extrusion temperatures higher than 180° C and up to the critical temperature of n-hexane (235° C) may be used.

For the purposes of this invention, the preferred amount of propylene in the composition to be extruded is at least 10 mols, and more preferably from 12 to 25 mols per 100 mols of the hexane-propylene solution. Generally, when the concentration of the dissolved propylene and the extrusion temperature are high, instead of a homogeneous solution there is a mixture of two liquid phases: a continuous phase poor in polymer, and another phase rich in polymer and dispersed in the continuous phase.

Thus, in accordance with the invention, there is provided a process for preparing polypropylene fibrils which consists in extruding through an orifice a solution or dispersion of polypropylene in n-hexane, under such conditions of temperature and pressure that the solvent in almost immediately evaporated in the extrusion enviroment, and in conveying against the extruded solution or dispersion a gaseous fluid jet having a high velocity and an angular direction with respect to the direction of extrusion of the solution or dispersion, said process being characterized in that the polymer solution or dispersion to be extruded contains from 2 to 25 moles of propylene monomer per 100 moles of hexane-propylene solution and in that the solution or dispersion is extruded at a temperature equal to or higher than 180° C.

Inorganic fillers, surfactants, and pigments may be added to the polypropylene solution or dispersion to be extruded.

As gaseous fluid there can be employed any of the matters in the gas or vapor state as are described for a similar purpose in Italian Pat. No. 947,919; Italian Patent Application No. 29,594 A/74; Belgian Pat. No. 787,033 and German Patent Application DT-DOS No. 2,339,044.

The following examples are given to illustrate the invention in more detail and are not intended to be limiting.

NOTE: [In the examples, the fibrils were prepared by the method described in Italian Patent Application No. 29,594 A/74 (and in the pending United States Application of Di Drusco et al, Ser. No. 633,116 filed Nov. 18, 1975), according to which the polymer solution or dispersion is extruded through one or more nozzles in the divergent portion of a pipe of the convergent-divergent type through which a high-speed gaseous fluid flows.

The convergent-divergent pipe used to prepare the fibrils in the following examples had a narrowed (critical) circular section having a diameter of 6 mm., a maximum (terminal) circular section of the divergent portion having a diameter of 8 mm., and a distance between the narrowed section and the terminal section of 20 mm.

The polymeric composition was extruded through 2 cylindrical holes, each having a diameter of 1.5 mm., symmetrically arranged around the terminal section of the divergent portion of the pipe, with an extrusion direction of about 90° with respect to the longitudinal axis of the pipe. Nitrogen was employed as the gaseous fluid, at room temperature, and under such conditions to impact the extruded polymeric composition at a velocity of about 800 m/sec. The polymeric composition was extruded at a velocity of about 55 m/sec.].

The fibrils obtained can be used directly, without preliminary cutting or reducing operations, in whole or in part as substitutes for cellulose fibers in the manufacture of paper and paper-like articles by conventional methods.

EXAMPLE 1

500 g of polypropylene (M.I. = 10, [m] = 1.6, density = 0.9053, isotacticity index = 93, crystallinity = 58%) 10 l of n-hexane and 10 g of a surfactant consisting of ethoxylated stearylamine were introduced into a 24 l autoclave, equipped with a heating jacket and with a comb stirrer. By means of heating, and by introducing contemporaneously gaseous propylene, under stirring, the following conditions were obtained in the autoclave:

temperature = 185° C total pressure = 28 kg/cm$^2$ gauge propylene concentration in n-hexane = 17 moles for 100 moles of hexane-propylene solution (corresponding to a propylene overpressure of 15 kg/cm$^2$ gauge).

The polymeric composition, consisting in this instance of two liquid homogeneously dispersed phases, was extruded under such conditions, according to the modalities described in the foregoing [NOTE] thus obtaining, as a product, individual fibrils having a surface area > 1 m$^2$/g, 85% of which had a length comprised between 1 and 3 mm., and a diameter between 15 and 25 $\mu$, while the remaining 15% had a length in part < 1 mm., and in part between 3 and 5 mm., and a diameter between 25 and 40 $\mu$.

EXAMPLE 2

500 g of polypropylene of the same type as described in Example 1, along with 10 l of n-hexane and 330 g of kaolin in the form of a powder having a particle size of about 3 $\mu$ were introduced into the autoclave of Example 1.

The conditions obtained in the autoclave, under stirring, were as follows:

temperature = 190° C total pressure = 25 kg/cm$^2$ gauge propylene dissolved in n-hexane = 12 moles for 100 moles of hexane-propylene solution (corresponding to a propylene overpressure of 11 kg/cm$^2$ gauge).

Under such conditions, a mixture of two liquid and homogeneously dispersed phases was obtained, which provided, through extrusion under the conditions set forth in the foregoing [NOTE], individual fibrils having a surface area > 1 m$^2$/g, 85% of which had a length ranging from 1 to 3 mm., and a diameter from 15 to 25 $\mu$, while the remaining 15% had a length in part < 1 mm., and in part between 3 and 5 mm., and a diameter between 25 and 40 $\mu$.

Examples of catalysts which can be used to prepare the polypropylene fibrils of which are obtained in accordance with this invention are those prepared, for example, from a component (A) which is $TiCl_4$, $TiCl_3$ or $TiCl_3.AlCl_3$ and a component (B) which is an alkyl Al compound, and such catalysts in which component (A) includes a support which consists essentially of Mg or Mn dihalide in an activated state.

Any catalyst which polymerizes propylene to fiber-forming polypropylene can be used.

We claim:

1. A process for preparing polypropylene fibers which are directly usable, without cutting or reducing operations, as substitutes, in whole or in part, for cellulose fibers in the manufacture of paper and paper-like articles, said process consisting in extruding through an orifice a solution or dispersion of polypropylene in n-hexane under conditions such that the solvent is evaporated practically immediately in the extrusion environment, and in conveying against the extruded solution or dispersion a gaseous fluid jet having a high velocity and an angular direction with respect to the direction of extrusion of the polypropylene solution or dispersion, and being characterized in that the polypropylene solution or dispersion extruded contains from 2 to 25 moles of monomeric propylene per 100 moles of hexane-propylene solution and in that the solution or dispersion is extruded at a temperature comprised between 180° C and 235° C.

2. The process of claim 1, in which the monomeric propylene is present in the polypropylene solution or dispersion in an amount ranging from 12 to 25 moles per 100 moles of hexane-propylene solution, and the solution or dispersion is extruded at a temperature comprised between 180° C and 190° C.

3. The process of claim 1, in which the polypropylene solution or dispersion containing the monomeric propylene is the unrefined reaction product obtained by polymerizing propylene in n-hexane and which contains unreacted propylene.

* * * * *